United States Patent [19]

Franzl

[11] 4,127,967

[45] Dec. 5, 1978

[54] BURGLAR-RESISTANT DOOR ASSEMBLY

[76] Inventor: Gertrude K. Franzl, 105-25 65th Ave., Forest Hills, New York, N.Y. 11375

[21] Appl. No.: 730,132

[22] Filed: Oct. 6, 1976

[51] Int. Cl.[2] ..... E06B 7/28

[52] U.S. Cl. ..... 49/171; 70/416; 292/DIG. 2

[58] Field of Search ..... 70/416; 292/DIG. 2; 49/171

[56] References Cited

U.S. PATENT DOCUMENTS

| | | | |
|---|---|---|---|
| 2,461,676 | 2/1949 | Budak | 70/416 |
| 3,952,564 | 4/1976 | Maines | 70/416 |

FOREIGN PATENT DOCUMENTS

| | | | |
|---|---|---|---|
| 322103 | 11/1929 | United Kingdom | 70/416 |
| 329250 | 5/1930 | United Kingdom | 70/416 |

*Primary Examiner*—Kenneth Downey
*Attorney, Agent, or Firm*—John J. Posta, Jr.

[57] ABSTRACT

The improved burglar-resistant door assembly of the invention comprises a door frame, a door hingedly connected to one side of said frame, door latch means connected to the inside surface of said door, a peephole device extending through said door and a protective cover device releasably disposed over the peephole device and/or latch means to prevent tampering therewith. The cover device may comprise a suction cup or pivotally mounted cover plate over the peephole or a screw cover on a threaded track around the peephole, or latch means, or an elastic cover stretched over and gripping the latch means. The latch means may be, for example, a door knob, dead bolt knob or the like. In one embodiment of the cover device, a spaced pair of parallel tracks are mounted on said door inner surface on opposite sides of said latch means and run from about the edge of the door containing the latch means to a location past the latch means and towards the opposite hinge-bearing edge of said door. A cover is slidably mounted on the tracks over the latch means and comprises a closed face, one closed end and an open opposite end, the latter facing toward and preferably at about said latch-bearing door edge. Preferably, a stop hood is secured to that end of the tracks which is adjacent the latch-bearing door edge, and overlies the open cover end to prevent tampering therewith.

4 Claims, 12 Drawing Figures

BURGLAR-RESISTANT DOOR ASSEMBLY

BACKGROUND OF THE INVENTION

1. Field of the Invention

The present invention generally relates to anti-burglar devices and more particularly to burglar resistant door assemblies for homes, apartments, offices and the like.

2. Prior Art

The usual types of protective devices installed on exterior doors of homes, offices, factories and the like comprise either complicated and expensive electrical warning devices and the like or latches in the form of extra locks, dead-bolts and the like. Most such locks, dead-bolts and the like have knobs which permit unlocking and locking of the same from the inside, as a convenience. However, easy access to such locks, dead-bolts and the like from the inside so as to unlock the same can be afforded if the usual type of peephole is present in the door. Most such peepholes are plugged by peephole optical sighting devices which, however, can be easily pushed in and through the door. Stiff wires can then be run through the resulting peepholes from outside the door to engage and unlock such locks, dead-bolts and other types of latches from the inside.

Accordingly, there is a need for an improved door assembly which protects the door when it includes a peephole device and latch means carried on the inside of the door. Such assembly should be inexpensive, simple, durable and effective and should not result in any inconvenience while it is being used.

SUMMARY OF THE INVENTION

The foregoing needs have been satisfied by the improved burglar-resistant door assembly of the present invention. The assembly is substantially as set forth in the Abstract above. Thus, it comprises a door frame, a door hingedly connected to one side thereof, door latch means and a peephole device connected to the door and a protective cover device which is releasably disposed over the latch means and/or peephole device to prevent tampering therewith. If the peephole is protected against entry, the latch means need not be. If the peephole is not so protected, the latch means should be. The present cover device cannot easily be removed from the outside once it is in place. Therefore, the door cannot be opened because other wires to manipulate the latch cannot be shoved through the peephole, or, if the latch is protected and the peephole is not, the wires can be placed through the peephole but cannot harm the latch. Thus, the door is effectively protected against unauthorized opening thereof from the outside, as by a burglar or the like.

The cover device may be, for example, an elastic stretch cover over the latch means or a suction cup or swivel plate over the peephole device. It can also be a cup screwed on a circular track around the latch or peephole device. It can also include a pair of parallel, spaced, preferably horizontal tracks running from the latch-bearing door edge inwardly towards the opposite door edge and bracketing the latch. A cover is disposed on the tracks over the latch to prevent access thereto. The cover has a closed end and an open opposite end facing the latch-bearing door edge.

The end of the tracks near the latch-bearing door edge also preferably includes a hood which acts as a stop against movement of the cover beyond that door edge and which prevents easy access to the open end so that the cover cannot easily be slid away from that door edge to expose the latch. These improvements result in improved protection against opening of the door by burglars and other intruders. Moreover, the improvements are provided in a simple, inexpensive, durable and convenient manner. Further advantages are set forth in the following detailed description and accompanying drawings.

DRAWINGS

DETAILED DESCRIPTION

Figure 1:
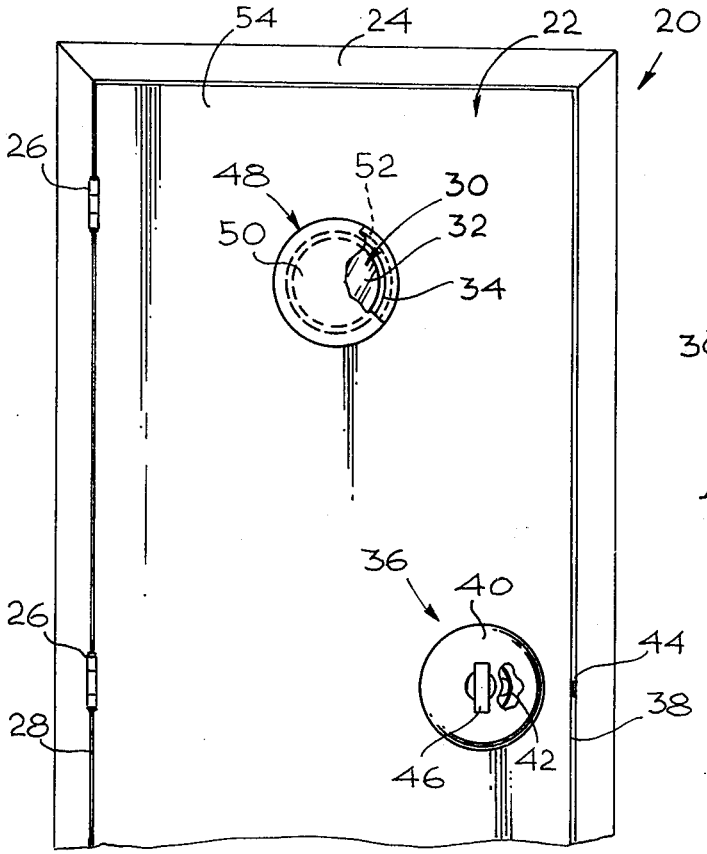
FIG. 1 is a fragmentary schematic front elevation, of a first preferred embodiment of the improved burglar resistant door assembly of the present invention.
Figure 6:
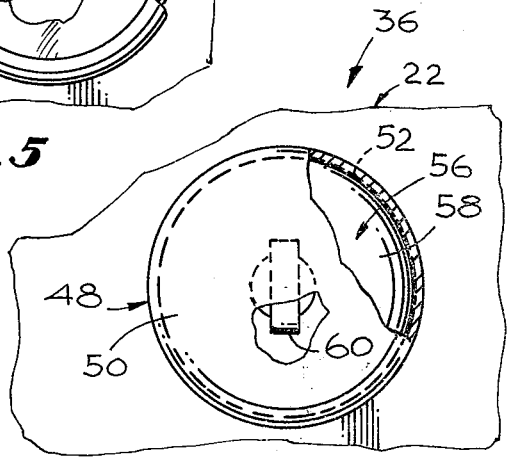
FIG. 6 is a schematic front elevation of a sixth embodiment of the cover device of the present improved assembly.

FIGS. 1 and 6

Now referring more particularly to FIG. 1 of the accompanying drawings, there is depicted schematically therein a first preferred embodiment of the improved burglar-resistant door assembly of the present invention. Thus, an assembly 20 is shown which includes a door 22 attached to a door frame 24, as by hinges 26 along one side 28 thereof, a peephole device 30 extending therethrough and comprising a lens 32 and lens frame 34 and door latch means 36 adjacent the opposite edge 38 of door 22 and extending therethrough. The latch means 36 comprises a door knob 40 on a shank 42 connected to a turn mechanism (generally not shown), including a latch tongue 44 releasably extending through edge 38 into frame 24. Knob 40 bears a turn lock button 46.

Assembly 20 is provided with effective protective cover means 48 comprising a cover cup 50 threadably releasably screwed on a circular track 52 which extends around device 30, so that cup 50 wholly encloses and seals off the portion of device 30 which protrudes from the inside 54 of door 22. This prevents peephole device 30 from being pushed in and entirely through door 22 and dropping away therefrom so as to expose the cavity in which device 30 resides, and thereby permitting access to lock button 46, as by wires, etc. placed from outside door 22 through that cavity. Moreover, cup 50 can be easily unscrewed from track 52 when peephole device 30 is to be used. Accordingly, door assembly 20 is simple and inexpensive and has improved burglar resistance.

FIG. 6 shows the further application of cover means 48 to door 22. Thus, means 48 is applied to latch means 36, specifically to a dead-bolt device 56 on door 22. Track 52 is shown disposed around a dead bolt lock 58 having a turn knob 60 to operate the positioning of the dead bolt (not shown). Cup 50 is releasably screwed on track 52 so as to wholly enclose device 56, thus preventing the undesired turning of knob 60 and opening of door 22. Again, improved protection against unauthorized entry through door 22 is afforded.

FIG. 2

Figure 2:
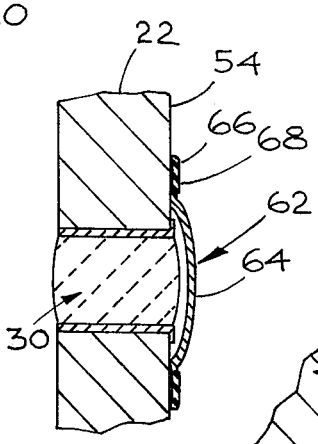
FIG. 2 is a schematic fragmentary cross-section of a second embodiment of the cover device of the present improved assembly.

A modified version of the protective cover means of the invention as applied to a peephole device is schematically shown in cross section in FIG. 2. Thus, cover means 62 is shown substituted for cover means 48 and includes a dish-shaped metal plate 64 connected at its periphery to a flexible rubber rim 66 to form a protective suction cup 68 releasably secured, as by rim 66, in place over a peephole device 30 on the inside 54 of door 22.

With this arrangement, device 30 cannot be pushed in so as to drop away from the inner surface 54 of door 22 and thereby expose a cavity (not shown) through which latch unlocking wires (not shown) could be inserted to open door 22 from the inside, as previously described.

Figure 3:
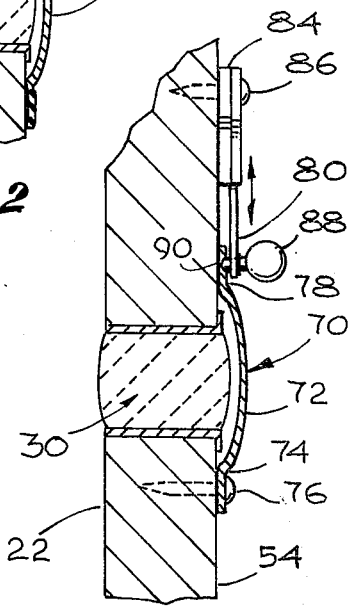
FIG. 3 is a schematic fragmentary cross-section of a third embodiment of the cover device of the present improved assembly.
Figure 4:
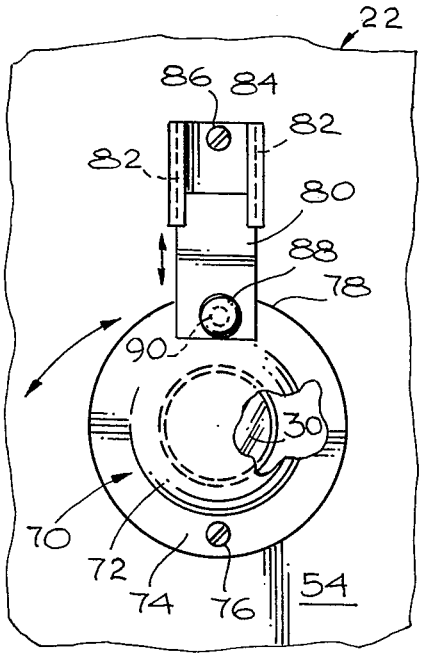
FIG. 4 is a fragmentary schematic front elevation of a fourth embodiment of the cover device of the present improved assembly.

FIGS. 3 and 4

In FIGS. 3 and 4, cover means 70 is shown in cross-section substituted for cover means 48 on door 22 in protecting peephole device 30. Cover means 70 includes a curved metal plate 72 secured at its lower end 74 to the inside 54 of door 22 by a pivot pin 76 and releasably secured at its upper end 78 by a lock slide 80 disposed in tracks 82 (FIG. 4) on a track plate 84, in turn affixed to surface 54 by a screw 86 which can act as a friction stop for slide 80 to hold it up out of the way, when desired.

Slide 80 bears a handle 88 to facilitate movement of slide 80, and a friction stop 90 is provided under handle 88 to releasably hold end 78 in place over device 30. When plate is in place, as shown in FIGS. 3 and 4, device 30 cannot be pushed in so as to expose the cavity in which it resides. However, when slide 80 is retracted up above end 78, plate 72 rotates on pin 76 so as to drop clear of device 30, allowing device 30 to be freely used as a peepsight. Thus, improved effective protective means are provided for door 22.

FIG. 5

Figure 5:
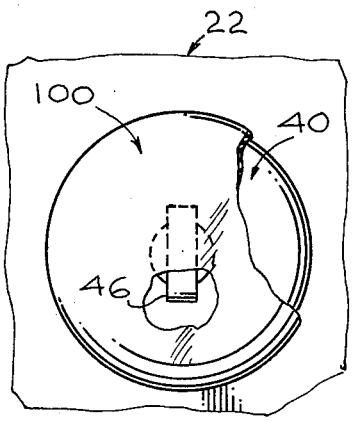
FIG. 5 is a schematic front elevation of a fifth embodiment of the cover device of the present improved assembly.

A further protective cover means in accordance with the present invention is shown in FIG. 5 installed on door knob 40 on door 22. Thus, as shown in FIG. 5, an elastic covering 100, for example, of a synthetic or natural rubber elastomer or the like, in accordance with the present invention is stretched taut over knob 40 so as to wholly enclose the same, thereby rendering direct access to turn lock button 46 thereof impossible. Covering 100 does not interfere with the use of knob 40 while knob 40 is in the unlocked state. Moreover, covering 100 can be easily peeled from knob 40 in order to operate button 46, and then covering 100 can be reinstalled on knob 40, as desired. Thus, door 22 is more effectively protected by this simple expedient against unauthorized access.

Figure 7:
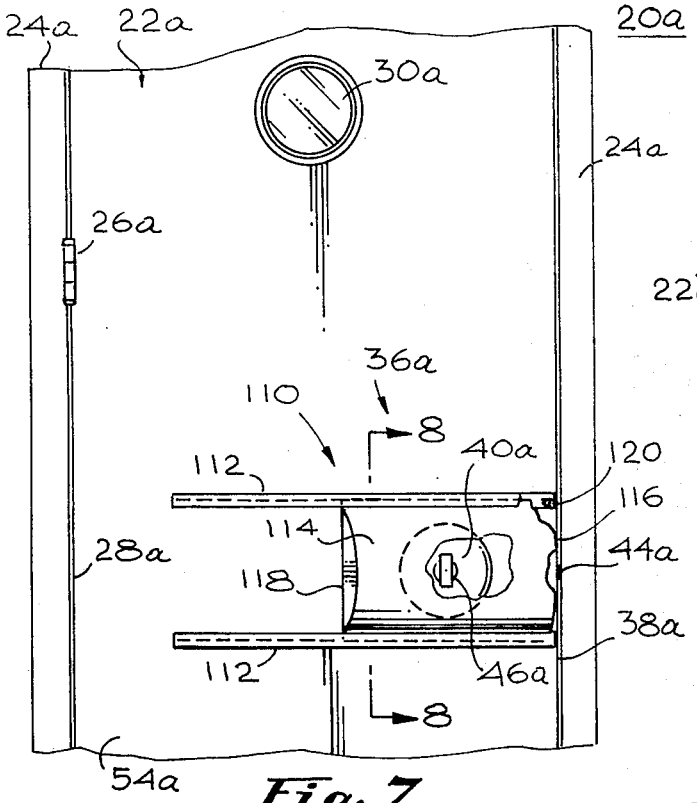
FIG. 7 is a schematic front elevation of a seventh embodiment of the cover device of the present improved assembly.
Figure 8:
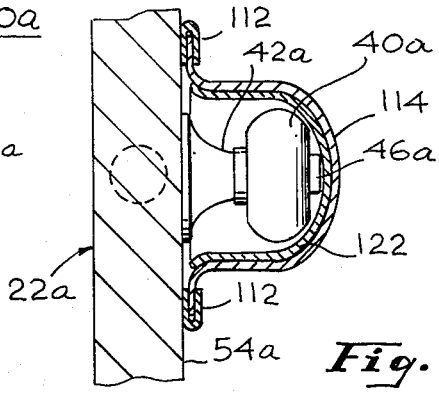
FIG. 8 is a schematic fragmentary cross-section of the embodiment of FIG. 7, taken along the section line 8—8 of FIG. 7.

FIGS. 7 and 8

A further embodiment of the present invention is schematically depicted in FIGS. 7 and 8. Thus, FIG. 7 shows a door assembly which is generally similar to that of FIG. 1. Accordingly, components thereof similar to those of FIG. 1 bear the same numerals but are followed by the letter "a". Thus, assembly **20*a* is shown which includes a door 22*a* connected to a frame 24*a* by hinges 26*a*, a peephole device 30*a* latch means 36*a* comprising a door knob 40*a* with interconnected shank 42*a* and tongue 44*a*, and improved cover means 110. The latter includes a pair of horizontally disposed spaced tracks 112 secured to surface 54*a* of door 22*a* on opposite sides of knob 40*a* and a cover 114 slidably received on tracks 112 and extending over knob 40*a* so as to prevent access to turn lock button 46*a* thereof. Tracks 112 run from about edge 38*a* inwardly toward opposite end 28*a* and past knob 40*a***.

Cover 114 is open at the end 116 thereof which faces latching-bearing edge **38*a* of door 22*a* and adjacent frame 24*a*, but is closed at the opposite end 118 thereof. Moreover, cover 114 is smooth and rounded, including at end 118, affording little or no purchase for surreptitiously sliding the same, as by wires, etc., to expose knob 40*a*. To further resist such unauthorized sliding of cover 114 by such means, a friction stop 120 is provided adjacent edge 38*a* on one or both tracks 112 and below a hood 122. Cover 114 engages stop 120 when cover 114 is in the position shown in FIG. 7. Hood 122 extends over cover 114 and down between end 116 and edge 38*a*. It prevents open end 116 from being reached, as by a hook or the like operated by a burglar or the like, and also acts as a stop to prevent cover 114 from inadvertently sliding beyond edge 38*a* when door 22*a* is open and then banging on frame 24*a* when closing door 22*a***.

When it is desired to turn knob **46*a* or knob 40*a*, cover 114 is grasped, forced past detent 120 and slid away from edge 38*a* until knob 40*a* is exposed. In fact, cover 114 can be left in this knob-exposing position on door 22*a* until it is time to secure door 22*a*, whereupon cover 114 can be moved to the position shown in FIG. 7, fully sealing knob 40*a* from tampering from outside door 22*a*, as through a peephole after extraction of device 30*a*. Accordingly, device 20*a*** is compact, inexpensive and highly effective.

It will be understood that, if desired, hood 122 can be eliminated, in which event when door **22*a* is closed and secured, end 116 is moved to abut and thus be protected by frame 124*a* adjacent edge 38*a***.

FIG. 9

Figure 9:
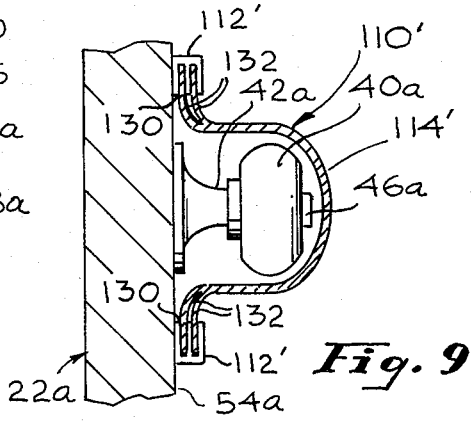
FIG. 9 is a schematic fragmentary cross-section of an eighth embodiment of the cover device of the present improved assembly.

A modification of the track arrangement for the cover means of assembly **20*a* is shown in cross-section in FIG. 9. Thus, knob 40*a*, with turn button 46*a* and shank 42*a*, is shown disposed on side 54*a* of door 22*a* but wholly enclosed within and protected against tampering by cover means 110' comprising cover 114' disposed in sliding engagement with spaced tracks 112' bracketing knob 40*a*. Each track 112' has a pair of spaced grooves 130 within which are received fingers 132 of cover 114' for sliding engagement. Cover means 110' is otherwise essentially the same as cover means 110**.

FIG. 10

Figure 10:
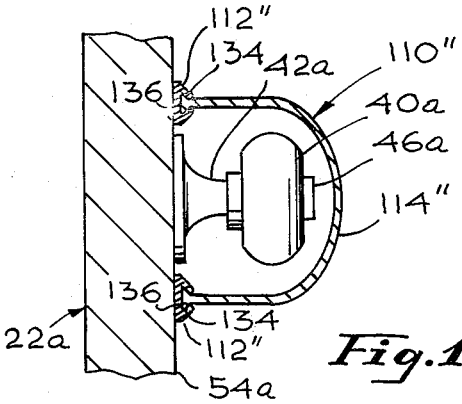
FIG. 10 is a schematic fragmentary cross-section of a ninth embodiment of the cover device of the present improved assembly.

A further modification of the track arrangement for the cover means of assembly 20a is shown in cross-section in FIG. 10. Thus, knob 40a, with button 46a and shank 42a, is shown disposed on side 54a of door 22a but wholly enclosed within and protected against tampering by cover means 110'' comprising cover 114'' with its wedge-shaped ends 134 slidably disposed within wedge-shaped grooves 136 in tracks 112''. Cover means 110'' is otherwise essentially the same as cover means 110.

Figure 12:
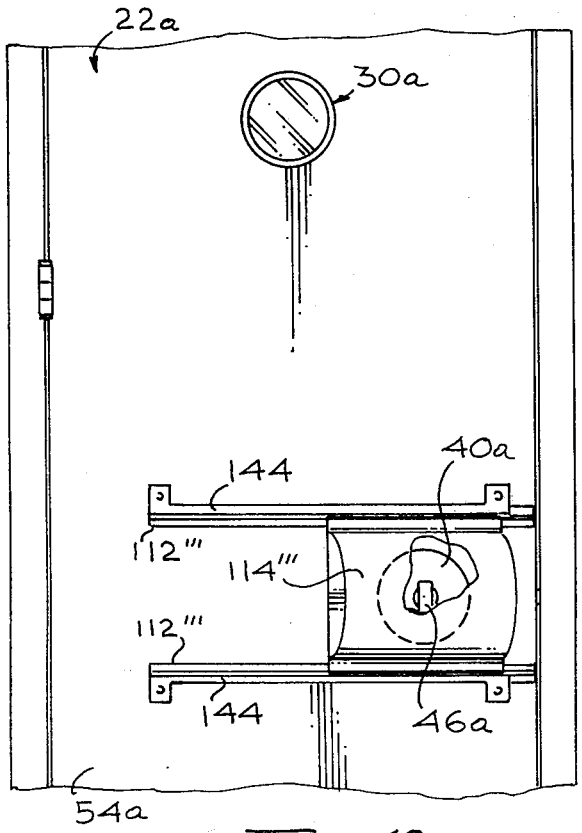
Figure 11:
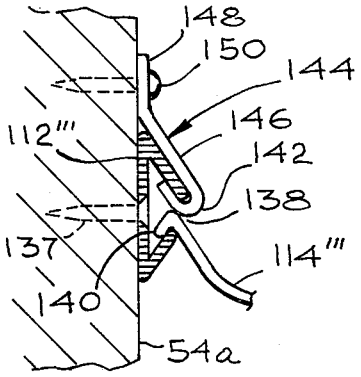
FIG. 11 is an enlarged schematic fragmentary cross-section of a tenth embodiment of the cover device of the present improved assembly; and, FIG. 12 is a schematic fragmentary front elevation of the embodiment of FIG. 11.

FIGS. 11 and 12

Another modification of the track arrangement for the cover means of assembly 20a is shown in enlarged cross-section in FIGS. 11 and 12. Thus, track 112''' is shown in FIG. 11 attached to surface 54a of door 22a, as by screws 137. Track 112''' is triangular in cross-section, with an open groove 138 within which are disposed the bent edge 140 of cover 114''' and the generally U-shaped end 142 of a lock bar 144. Lock bar 144 is designed to prevent removal of cover 114''' from track 112''' and to prevent prying up of track 112''' from surface 54a by overlying the upper edge of track 112'''. It will be seen that bar 144 includes a protective sloped section 146 and a connector tab 148, through the latter of which extends a screw 150 into surface 54a.

As will be seen from FIG. 12, a pair of tracks 112''' are provided, and a pair of lock bars 144 are provided to protect tracks 112'''. Bars 144 do not interfere with the operation of cover 114''' in protecting knob 40a and its turn button 46a when and if door 22a is breached, as through the cavity for device 30a. As with cover 114, cover 114''' can be slid to expose knob 40a and in fact can be left on surface 54a in that position until knob 40a is to be protected by cover 114'''. The advantages of the present device therefore include convenience, as well as utility.

It will be understood that the improved door assemblies of the present invention and their components can be made of various materials with various parameters. Thus, the protective covers thereof may be of metal, plastic, wood and other durable materials, and combinations thereof. Moreover, various modifications, alterations, changes and additions can be made in the assemblies of the present invention and in their components. All such modifications, changes, alterations and additions within the scope of the appended claims form part of the present invention.

What is claimed is:

1. Improved burglar-resistant door assembly, said assembly comprising, in combination:

a. a door frame;

b. a door hingedly connected to one side of said frame;

c. door latch means connected to the inside surface of said door;

d. a peephole device extending through said door;

e. a protective cover device releasably disposed over said latch means on the inside surface of said door so as to prevent tampering with said latch means from outside said door, said cover device having a top portion, two oppositely disposed sides, one closed end integral with said top portion, and a completely open end disposed opposite said closed end;

f. wherein said cover device comprises a pair of spaced parallel tracks mounted on said door inner surface on opposite sides of said latch means and running from about the edge of said door containing said latch means to a location past said latch means and away from said door edge, and a cover slideably mounted on said tracks over said latch means, said cover having a closed face overlying said latch means, and a closed end and an opposite open end, the latter end facing toward said door edge and the portion of said door frame adjacent said door edge;

g. wherein said open cover end extends to about said door edge and wherein said track is of sufficient length to permit said cover to be slid therealong away from said door edge to expose said latch means; and h. wherein said cover device includes a hood adjacent the end of said tracks near said door edge and extending over and around said open cover end to prevent tampering therewith.

2. The improved door assembly of claim 1 wherein detent means releasably hold said cover in a protective position over said latch means and wherein said hood prevents movement of said cover over said latch-bearing door edge.

3. The improved door assembly of claim 11 wherein said cover device includes a protective lock bar secured to said door inner surface and movable to a position overlying and protecting at least one of said tracks.

4. The improved door assembly of claim 11 wherein each of said tracks is generally three sided, wherein said cover rides on a first side of each of said tracks and wherein a pair of said lock bars are provided, said bars riding on a second side of said tracks to prevent withdrawal of said cover from said tracks.

* * * * *